US011873802B2

(12) United States Patent
Higgins et al.

(10) Patent No.: US 11,873,802 B2
(45) Date of Patent: Jan. 16, 2024

(54) PUMP HAVING MULTI-STAGE GAS COMPRESSION

(71) Applicant: Graco Minnesota Inc., Minneapolis, MN (US)

(72) Inventors: Jacob D. Higgins, White Bear Township, MN (US); Benjamin J. Paar, Minneapolis, MN (US); Brian W. Koehn, Minneapolis, MN (US); Bradley H. Hines, Andover, MN (US); Paul W. Scheierl, Chisago City, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 281 days.

(21) Appl. No.: 17/320,979

(22) Filed: May 14, 2021

(65) Prior Publication Data

US 2021/0355929 A1 Nov. 18, 2021

Related U.S. Application Data

(60) Provisional application No. 63/026,626, filed on May 18, 2020.

(51) Int. Cl.
*F04B 45/04* (2006.01)

(52) U.S. Cl.
CPC ..... *F04B 45/04* (2013.01)

(58) Field of Classification Search
CPC ..... F04B 27/02; F04B 27/0673; F04B 35/04; F04B 25/00–02; F04B 27/047–0478; F04B 35/01; F04B 45/04–0536; F04B 45/047; F04B 49/03; F04B 49/22–246
USPC ..... 417/250, 254–265, 418, 534
See application file for complete search history.

(56) References Cited

U.S. PATENT DOCUMENTS 3,692,437 A * 9/1972 Ray ..... F04B 45/043 92/48
3,834,840 A * 9/1974 Hartley ..... F04B 39/00 417/535
4,093,403 A 6/1978 Schrimpf et al.
4,565,501 A * 1/1986 Laurendeau ..... F02M 37/046 417/267
5,324,175 A * 6/1994 Sorensen ..... F04B 9/1295 417/397
5,380,164 A * 1/1995 Fry ..... F04B 19/06 347/85
5,584,669 A * 12/1996 Becker ..... F04D 25/16 417/205
6,071,085 A * 6/2000 Bernhardt ..... F04B 25/005 417/252

(Continued)

FOREIGN PATENT DOCUMENTS

CN 104976106 A * 10/2015
EP 0207212 A1 1/1986

(Continued)

*Primary Examiner* — Alexander B Comley
(74) *Attorney, Agent, or Firm* — Kinney & Lange, P.A.

(57) ABSTRACT

A displacement pump has multiple gas compression stages and serial gas flow through the compression stages. The gas is initially compressed in a first compression stage by a first fluid displacement member. The gas from the first compression stage flows to a second compression stage. The gas in the second compression stage is compressed by a second fluid displacement member and output from the pump.

18 Claims, 8 Drawing Sheets

(56) References Cited

U.S. PATENT DOCUMENTS

| | | | | |
|---|---|---|---|---|
| 6,595,758 | B1 | 7/2003 | Hauser et al. | |
| 6,817,839 | B2 * | 11/2004 | Hauser | F04B 37/14 417/253 |
| 7,661,933 | B2 | 2/2010 | Ohya et al. | |
| 8,657,588 | B2 * | 2/2014 | Lund | F04B 9/06 417/259 |
| 2009/0220357 | A1 | 9/2009 | Baumer et al. | |
| 2015/0010409 | A1 * | 1/2015 | Burggraf | F04B 53/04 417/253 |
| 2015/0361970 | A1 * | 12/2015 | White | F04B 53/143 417/320 |
| 2016/0123314 | A1 * | 5/2016 | Ignatiev | F04B 39/10 417/374 |

FOREIGN PATENT DOCUMENTS

| | | | | |
|---|---|---|---|---|
| EP | 207212 | A * | 1/1987 | F04B 43/026 |
| EP | 0715077 | A2 * | 6/1996 | |
| FR | 2420671 | A1 | 10/1979 | |
| FR | 2420671 | A * | 11/1979 | F04B 25/00 |
| GB | 1418993 | A * | 12/1975 | F04B 43/0054 |
| GB | 2395237 | A * | 5/2004 | F04B 35/045 |

* cited by examiner

PUMP HAVING MULTI-STAGE GAS COMPRESSION

CROSS-REFERENCE TO RELATED APPLICATION(S)

This application claims priority to U.S. Provisional Application No. 63/026,626 filed on May 18, 2020, and entitled "PUMP HAVING MULTI STAGE GAS COMPRESSION," the disclosure of which is hereby incorporated by reference in its entirety.

BACKGROUND

This disclosure relates to pumping systems. More specifically, this disclosure relates to pumping systems for compressed gasses.

Gas pumps are used across a variety of applications, such as those used to extract gas from matter (e.g., vapor), develop a vacuum, and/or generate compressed gas. The pump includes a moving member, such as a piston, that pumps the gas for the desired application. The pump is controlled to achieve the desired pressure and flow rate for the process gas pumped by the pump. The environments that gas pumps are used in can be crowded where space is at a premium. Increasing the flow rate requires an increase in the size of the piston and/or the stroke length of the piston, which can be impractical in crowded operating environments. Piston compressors also require moving mechanical seals to maintain pressurization.

SUMMARY

According to an aspect of the disclosure, a pump configured to serially compress a gas includes a first compression stage having a first diaphragm, a first stage inlet, and a first stage outlet, the first diaphragm configured to reciprocate on a pump axis to alter a volume of a first compression chamber of the first compression stage; a second compression stage having a second diaphragm a second stage inlet and a second stage outlet, the second diaphragm configured to reciprocate on the pump axis to alter a volume of a second compression chamber of the second compression stage; a drive disposed at least partially between the first fluid displacement member and the second fluid displacement member, the drive operably connected to the first fluid displacement member and the second fluid displacement member to displace the first fluid displacement member through a first suction stroke and to displace the second fluid displacement member through a second suction stroke. The first compression stage is fluidly connected to the second compression stage such that gas compressed in the first compression chamber in the first compression stage is routed to the second compression chamber.

According to an additional or alternative aspect of the disclosure, a method of compressing a gas includes reciprocating a first diaphragm along a pump axis and a second diaphragm along the pump axis with a drive disposed at least partially directly between the first diaphragm and the second diaphragm; compressing the gas in a first compression chamber to a first pressure with the first diaphragm; expelling the compressed gas from the first compression chamber through a first outlet of the first compression chamber; routing the compressed gas from the first compression chamber into a second compression chamber; compressing the compressed gas to a second pressure greater than the first pressure in the second compression chamber with a second diaphragm configured to reciprocate on the pump axis; and expelling the compressed gas from the second compression chamber. A pumping stroke of the first diaphragm both compresses the gas within the first compression chamber and moves previously compressed gas into the second compression chamber.

DETAILED DESCRIPTION

Figure 1:
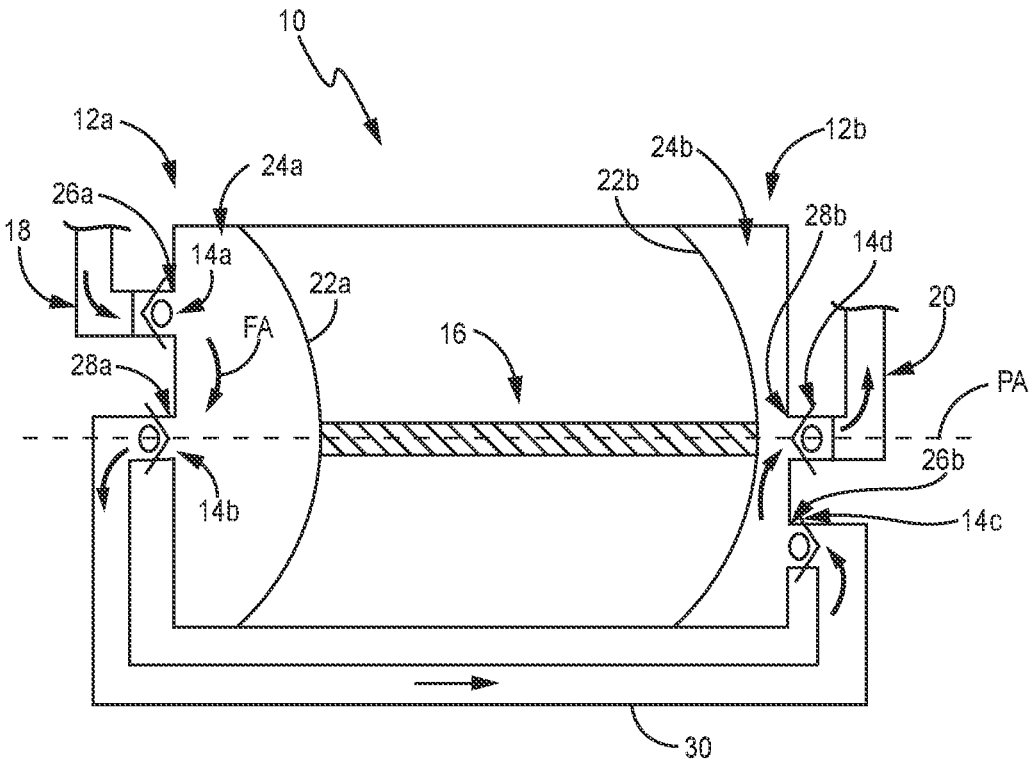
FIG. 1 is a schematic block diagram of a pump system.

FIG. 1 is a schematic block diagram of pump 10. Pump 10 includes compression stages 12*a*, 12*b*; check valves 14*a*-14*d*, drive 16, inlet conduit 18, and outlet conduit 20. Compression stages 12*a*, 12*b* respectively include fluid displacement members 22*a*, 22*b* and compression chambers 24*a*, 24*b*.

Pump 10 is configured to pump process gas, as indicated by flow arrows FA. For example, pump 10 can be used to extract gas from matter (e.g., vapor), develop a vacuum, and/or generate compressed gas, among other applications. In one example, pump 10 can be used in a system used to extract oils from organic matter. In some examples of such a system, cooled petroleum products, such as butane and propane, are used to strip oils from the organic matter. The resulting combination is heated and pump 10 can be used to extract the petroleum gasses for recirculation, condensation, and reuse in the extraction system. It is understood, however, that pump 10 can be used in any desired gas handling system.

Drive 16 is operably connected to components of pump 10 to cause pumping by pump 10. Drive 16 can be and/or include a motor, such as an electric motor among other options. The motor can be an electric rotary type motor, such as an alternating current (AC) induction motor or a direct current (DC) brushed or brushless motor, among other options. Drive 16 provides an output to mechanically drive fluid displacement members 22*a*, 22*b* through a suction stroke and, in some examples, through both suction and pumping strokes.

Pump 10 is configured to pump gas from inlet conduit 18 to outlet conduit 20. More specifically, compression stages 12*a*, 12*b* pump the gas from the inlet conduit 18 to the outlet conduit 20. Fluid displacement members 22*a*, 22*b* are disposed on opposite axial sides of drive 16 along pump axis PA. Fluid displacement members 22*a*, 22*b* at least partially define compression chambers 24*a*, 24*b*, respectively. Fluid displacement members 22*a*, 22*b* reciprocate within compression chambers 24*a*, 24*b* to pump the gas from the inlet conduit 18 to the outlet conduit 20. Fluid displacement members 22*a*, 22*b* reciprocate to alter the volumes of compression chambers 24*a*, 24*b*, respectively, to pump the gas. Fluid displacement members 22*a*, 22*b* can be of any configuration suitable for pumping gasses. For example, fluid displacement members 22*a*, 22*b* can be diaphragms or pistons, among other options. Whether fluid displacement members 22*a*, 22*b* are diaphragms, pistons, or of another configuration, the fluid displacement members 22*a*, 22*b* can have a circular cross-section orthogonal to their respective reciprocation axes and, in some examples, can be coaxial with respect to each other on pump axis PA.

Fluid displacement members 22*a*, 22*b* each linearly reciprocate through respective pump cycles, with each pump cycle including a pumping stroke and a suction stroke. In a pumping stroke, fluid displacement member 22*a*, 22*b* moves to decrease the available volume within the respective compression chamber 24*a*, 24*b* to compress gas within the compression chamber 24*a*, 24*b* as well as expel gas downstream from the compression chamber 24*a*, 24*b*. In a suction stroke, fluid displacement member 22*a*, 22*b* moves away from the respective compression chamber 24*a*, 24*b* to increase the available volume within the compression chamber 24*a*, 24*b* to pull more gas into the compression chamber 24*a*, 24*b* from upstream.

Fluid displacement members 22*a*, 22*b* can be fixed relative to each other or movable relative to each other during operation. As discussed in more detail below, fluid displacement members 22*a*, 22*b* can be moved by the drive 16 through respective suction strokes but decoupled from drive 16, and thus from the other fluid displacement member 22*a*, 22*b*, during respective pumping strokes. In some examples, fluid displacement members 22*a*, 22*b* are fixed relative each other such that fluid displacement member 22*a* is always 180-degrees out of phase with fluid displacement member 22*b*. For example, the first fluid displacement member 22*a* travels through its pumping stroke while the second fluid displacement member 22*b* travels through it suction stroke, and each changes over to the other phase at the same time. In some other embodiments, the fluid displacement members 22*a*, 22*b* can be offset in phase to some degree other than 180-degrees.

Fluid displacement members 22*a*, 22*b* are configured to draw gas into compression chambers 24*a*, 24*b* through inlets 26*a*, 26*b* and to output gas from compression chambers 24*a*, 24*b* through outlets 28*a*, 28*b*. Intermediate conduit 30 extends between and fluidly connects compression chamber 24*a* and compression chamber 24*b*. Intermediate conduit 30 defines a flowpath for serial flow through compression chambers 24*a*, 24*b*. Intermediate conduit 30 can be formed by a tube external to a body of pump 10, can be formed internally through a body of pump 10, or can be formed partially internal to the body of pump 10 and partially external to the body of pump 10.

Check valves 14*a*-14*d* regulate the flow of incoming and outgoing gas from the first and second compression chambers 24*a*, 24*b*. Check valve 14*a* is associated with inlet 26*a* and is configured to allow gas to flow into compression chamber 24*a* and to prevent retrograde flow out of compression chamber 24*a*. Check valve 14*b* is associated with outlet 28*a* and is configured to allow gas to flow downstream out of compression chamber 24*b* and to prevent retrograde flow to compression chamber 24*a*. Check valve 14*c* is associated with inlet 26*b* and is configured to allow gas to flow into compression chamber 24*b* and to prevent retrograde flow from compression chamber 24*b*. Check valve 14*d* is associated with outlet 28*b* and is configured to allow gas to flow downstream out of compression chamber 24*b* and to prevent retrograde flow to compression chamber 24*b*.

While check valve 14*b* and check valve 14*c* are described as separate components, it is understood that check valve 14*b* and check valve 14*c* can be integrated into a single flow regulating assembly. For example, pump 10 may include only three check valves, with a first check valve associated with inlet 26*a*, a second check valve associated with outlet 28*b*, and a third check valve intermediate the first and second compression stages 12*a*, 12*b*. The check valves 14*a*-14*d* can be flapper type, ball and seat, or other type of check valve. Further, some of the check valves 14*a*-14*d* can be a first type and other ones of the check valves 14*a*-14*d* can be one or more other types.

During operation, pump 10 serially compresses gas, which pumped gas can be referred to as a process gas. The gas flows serially through pump 10 between inlet conduit 18 and outlet conduit 20. Gas flows from inlet conduit 18 to compression chamber 24*a*, from compression chamber 24*a* to compression chamber 24*b* through intermediate conduit 30, and from compression chamber 24*b* to outlet conduit 20 in the serial flow mode.

Drive 16 is operated to cause reciprocation of fluid displacement members 22*a*, 22*b* through respective pump cycles. Fluid displacement member 22*a* draws gas into compression chamber 24*a* from inlet conduit 18 through inlet 26*a* during the suction stroke. Fluid displacement member 22*a* moves through the suction stroke to increase the volume of compression chamber 24*a*, thereby drawing gas into compression chamber 24*a*. The gas is pulled through first check valve 14*a* and into first compression chamber 24*a* by fluid displacement member 22*a*. Inlet 26*a* can also be referred to as a pump inlet because inlet 26*a* is the location that the process gas enters pump 10.

Drive 16 causes fluid displacement member 22*a* to changeover into a pumping stroke to compress the gas within compression chamber 24*a*. Fluid displacement member 22*a* moves through the pumping stroke to decrease the volume of compression chamber 24*a*, thereby increasing the pressure of the gas within compression chamber 24*a*. Fluid displacement member 22*a* moving through the pressure stroke can cause first check valve 14*a* to close. The pressure within first compression chamber 24*a* becomes equal to or greater than the gas pressure downstream of compression chamber 24*a*, such as within intermediate conduit 30 and/or within compression stage 12*b*. The pressure differential across check valve 14*b* allows fluid displacement member 22*a* to force the compressed gas out of compression chamber 24*a* through outlet 28*a*, past second check valve 14*b*, and into intermediate conduit 30. Fluid displacement member 22*a* changes stroke directions and repeats another pump cycle including a suction stroke and a pumping stroke.

Fluid displacement member 22*b* draws gas into compression chamber 24*b* from intermediate conduit 30 through inlet 26*b* during the suction stroke. Fluid displacement member 22*b* moves through the suction stroke to increase the volume of compression chamber 24*b*, thereby drawing gas into compression chamber 24*b*. The gas is pulled through first check valve 14*b* and into first compression chamber 24*b* by fluid displacement member 22*b*. It is understood that the gas can one or both of be pushed into compression chamber 24*b* by upstream pressure (e.g., due to movement of fluid displacement member 22*a* during a pumping stroke) and be pulled into compression chamber 24*b* by lower downstream pressure (e.g., due to movement of fluid displacement member 22*b* during the suction stroke).

Drive 16 causes fluid displacement member 22*b* to changeover into a pumping stroke to compress the gas within compression chamber 24*b*. Fluid displacement member 22*b* moves through the pumping stroke to decrease the volume of compression chamber 24*b*. In some examples, fluid displacement member 22*b* further increases the pressure of the gas within compression chamber 24*b*. The pressure within the second compression chamber 24*b* becomes equal to or greater than the gas pressure downstream of compression chamber 24*b*, such as within outlet conduit 20. The pressure differential across check valve 14*d* allows fluid displacement member 22*b* to force the compressed gas out of compression chamber 24*b* through outlet 28*b*, past fourth check valve 14*b*, and into outlet conduit 20. Outlet 28*b* can also be referred to as a pump outlet because outlet 28*b* is a location that the pumped gas exits pump 10. Fluid displacement member 22*b* then changes stroke directions and repeats another pump cycle including a suction stroke and a pumping stroke.

The gas flows serially through multiple compression stages to provide a higher pressure output from pump 10 than can be provided by a single compression stage. In particular, the embodiment of pump 10 shown includes two compression stage 12*a*, 12*b*, though it is understood that other numbers of compression stages are possible. The incoming gas is compressed in each of compression stages 12*a*, 12*b* serially such that the gas is compressed in the first stage 12*a* and then transported to the second stage 12*b* in which it is further compressed to an even greater degree (i.e. higher pressure), and then output from the pump 10. The gas is initially received at a base pressure. The base pressure can be ambient pressure, atmospheric pressure, uncompressed, compressed, or in another state. In some examples, inlet conduit 18 may be removed such that the pump inlet (e.g., inlet 26*a*) draws gas from the atmosphere surrounding pump 10. The gas experiences a first compression within compression stage 12*a*. Compression stage 12*a* outputs the gas at a first pressure, the first pressure greater than the base pressure. The gas flows to compression stage 12*b* and is acted upon by second fluid displacement member 22*b*. Compression stage 12*b* outputs the gas at a second pressure. The second pressure is greater than the base pressure and can be, in some examples, greater than the first pressure. During operation, the minimum second pressure actually being output by compression stage 12*b* is at least equal to the maximum first pressure actually being output by compression stage 12*b*.

In some examples, each of compression chamber 24*a*, intermediate conduit 30, and compression chamber 24*b* are at ambient pressure at the beginning of operation. Pump 10 can build standing pressure internally prior to outputting gas through outlet 28*b*. The standing pressure builds to a desired output pressure such that the second pressure output from pump 10 is at a desired pressure for operation. For example, the output of pump 10 can be put in a deadhead condition in which the pump outlet (e.g., outlet 28*b*) empties into a sealed reservoir or dead-end path. For example, outlet conduit 20 can dispense to or be a pressurized location, such as a holding tank. In other examples, outlet conduit 20 can be or include a valve that can be placed in a closed state, among other deadheading options. In examples where pump 10 is used for recovery and recirculation, such as in extraction systems for oils from organic compounds, the downstream location can be a pressurized recovery tank. The pressure in the tank can determine the operating pressure for pump 10. With the operating pressure level set, such as by the deadhead condition, fluid displacement members 22*a*, 22*b* reciprocate to move gas from the pump inlet 26*a* to the pump outlet 28*b*. Pump 10 ramps the standing pressure to be equal to or exceed the downstream system pressure.

In some examples, second compression stage outlet check valve 14*d* can be configured to have a crack pressure threshold such that, over multiple cycles of fluid displacement member 22*b* pressurized gas is progressively amassed in the second compression chamber 24*b* and then only passed through outlet check valve 14*d* and into outlet conduit 20 after the standing pressure of this supply of pressurized gas representing multiple pump cycles within compression chamber 24*b* overcomes the resistance of the second compression stage outlet check valve 14*d*. For example, a spring can bias the valve member of the check valve 14*d* into a closed state. The resistance of the spring is set to control the crack pressure at which check valve 14*d* actuates from the closed state to the open state. The standing pressure overcoming the resistance allows at least part of this mass of gas (which may represent more than a single cycle of the second compression stage 12*b*) to move through outlet 28*b* and downstream from pump 10.

During pressure ramping, fluid displacement member 22*a* compresses the gas to a first pressure that is output through outlet 28*a*. The pressurized gas having the first pressure flows through intermediate conduit 30 and to compression chamber 24*b*. Fluid displacement member 22*b* further compresses the already pressurized gas. The resistance at check valve 14*d* (e.g., due to pressure downstream of check valve 14*d* or a bias in check valve 14*d*) maintains check valve 14*d* in a closed state such that the gas pressure within compression chamber 24*b* increases from the first pressure to a second pressure. Pressure builds at the pump outlet 28*b* and in second compression chamber 24*b* such that there is continuously pressurized gas within the second compression chamber 24*b* before, during, and after each pump cycle. The standing pressure builds within the intermediate conduit 30 downstream of second check valve 14*b* such that there is continuously pressurized gas within the intermediate conduit 30 before, during, and after each pump cycle. The pressure continues to build in second compression chamber 24*b* until the second pressure reaches or exceeds the downstream (e.g., operating) pressure. The pressure differential across check valve 14*d* with second pressure reaching or exceeding the downstream pressure causes check valve 14*d* to shift to the open state to output the pressurized gas. The standing pressure in the second compression chamber 24*b* and the intermediate conduit 30 can, in some examples, be exhausted once the pump outlet 28 is allowed to vent to atmosphere, such as after operation.

In some examples, second compression stage inlet check valve 14*c*, or another check valve located between the compression stages 12*a*, 12*b* (e.g., check valve 14*b*) can be configured to have a crack pressure threshold such that, over multiple cycles of the fluid displacement member 22*a* pressurized gas is progressively amassed in the intermediate conduit 30 and then only passed into the second compression chamber 24*b* after the pressure of this reserve of pressurized gas representing multiple pump cycles within the intermediate conduit 30 overcomes the resistance of the second compression stage inlet check valve 14*c*. For example, the one or more intermediate check valves between compression stages 12*a*, 12*b* can have a spring biasing the valve member of the check valve into a closed state, with the spring resistance controlling the crack pressure. The pressurized gas overcoming the resistance allows at least part of this mass of gas (which may represent more than a single cycle of the first stage of compression) to move into the second compression chamber 24*b*.

The gas is initially compressed by first compression stage 12*a* and subsequently compressed by second compression stage 12*b*. Second compression stage 12*b* receives pre-pressurized gas and further compresses the gas to increase the pressure. In some examples, first compression stage 12*a* is configured to compress incoming gas to about 0.83 megapascal (MPa) (about 120 pounds per square inch (psi)) and second compression stage 12*b* is configured to further increase the pressure to about 1.03-1.17 MPa (about 150-170 psi).

In some examples, pump 10 is operated serially but with the second stage 12*b* acting as a pass-through stage. In such an operating mode, the second stage 12*b* may pump the gas without further pressurizing the gas. The second pressure can thus be substantively the same as the first pressure. Without the downstream resistance (e.g., either the deadhead condition or the crack pressure of the check valve) being greater than the first pressure, second compression stage 12*b* outputs flow during each pump cycle. As such, second compression stage 12*b* may only pass along the same volume that was compressed in the first compression stage 12*a* without further compressing the gas from the first compression stage 12*a*.

Compression stage 12*a* can both output gas from compression chamber 24*a* and pump gas into compression chamber 24*b* during a pumping stroke of fluid displacement member 22*a*. In some examples, the gas pumped into compression chamber 24*b* by compression stage 12*a* during a respective pumping stroke can be different from the gas expelled from compression stage 12*a* during that respective pumping stroke.

The displacement of a first one of fluid displacement members 22*a*, 22*b* can be greater than the displacement of a second one of fluid displacement members 22*a*, 22*b*. For example, the first fluid displacement member 22*a*, 22*b* can have a greater gas-contacting cross sectional area than the second fluid displacement member 22*a*, 22*b* such that the first fluid displacement member 22*a*, 22*b* displaces a greater volume per pumping stroke than the second fluid displacement member 22*a*, 22*b*. The first fluid displacement member 22*a*, 22*b* can displace the larger volume despite the same distance of travel for each pumping stroke of the fluid displacement members 22*a*, 22*b*.

Fluid displacement members 22*a*, 22*b* can be decoupled during at least a portion of the respective pump cycles. In some examples, one of the fluid displacement members 22*a*, 22*b* has a greater length of travel along axis PA than the other one of the fluid displacement members 22*a*, 22*b*. The fluid displacement member 22*a*, 22*b* with the greater length of travel can displace the larger volume of gas despite the other fluid displacement member 22*a*, 22*b* having the same or a greater gas-contacting cross-sectional area as compared to the greater length-of-travel fluid displacement member 22*a*, 22*b*.

The first fluid displacement member 22*a*, 22*b* can have a greater length of travel by being configured to travel a greater maximum distance through a pumping stroke or by moving more quickly through the pumping stroke. For example, each of fluid displacement members 22*a*, 22*b* can have a dedicated pressure source to displace that fluid displacement member 22*a*, 22*b* through its respective pumping stroke. The pressures can be set to different levels (e.g., a lower relative pressure for fluid displacement member 22*a* and a higher relative pressure for fluid displacement member 22*b*) to cause different displacement parameters for the fluid displacement members 22*a*, 22*b*.

Pump 10 provides significant advantages. Pump 10 is configured to compress gas to a first pressure level and can be operated to output the gas at that first pressure level or at a higher, second pressure level. Pump 10 thereby facilitates a range of output pressures for the pumped gas. Pump 10 is configured to compress gasses to pressures greater than those facilitated by a typical double diaphragm pump operating in parallel. The higher pressures can facilitate more efficient process gas recovery and recirculation. Fluid displacement members 22*a*, 22*b* being coaxial on pump axis PA reduces off balance loads on drive, increasing efficiency and preventing undesired wear on components of pump 10. Check valves 14*a*-14*d* regulate flow through pump 10 to facilitate building the standing pressure, facilitating pump 10 outputting gas at a second pressure greater than the first pressure output by compression stage 12*a*.

Figure 2A:
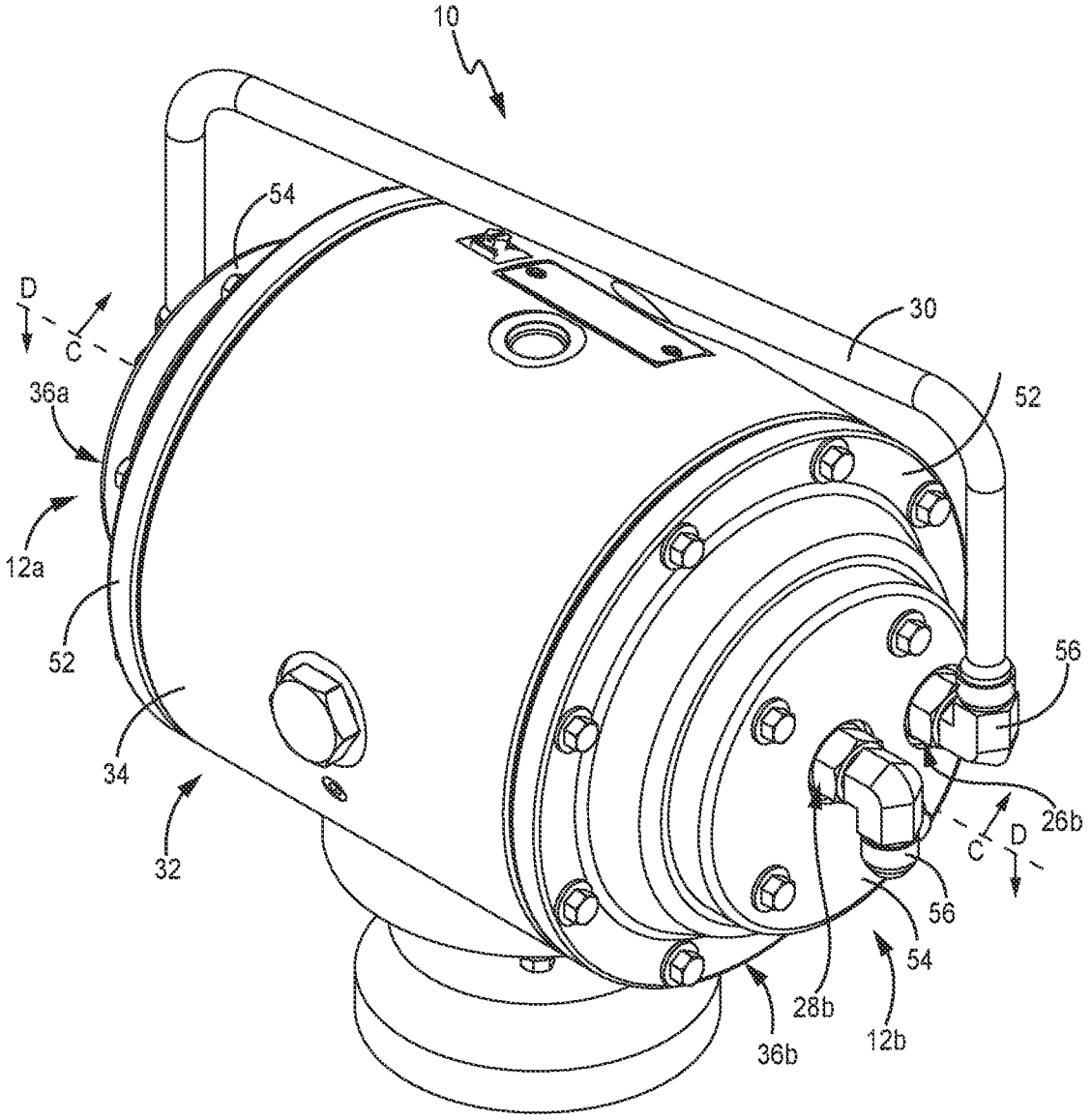
FIG. 2A is an isometric view of a pump.
Figure 2B:
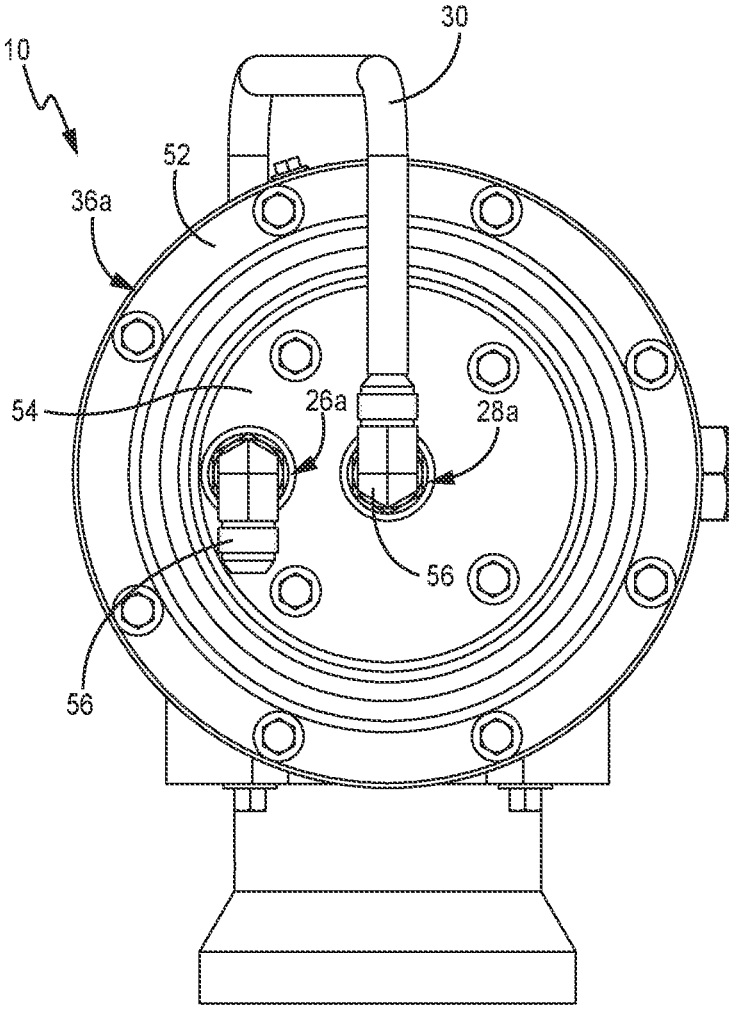
FIG. 2B is an end view of the pump.
Figure 2C:
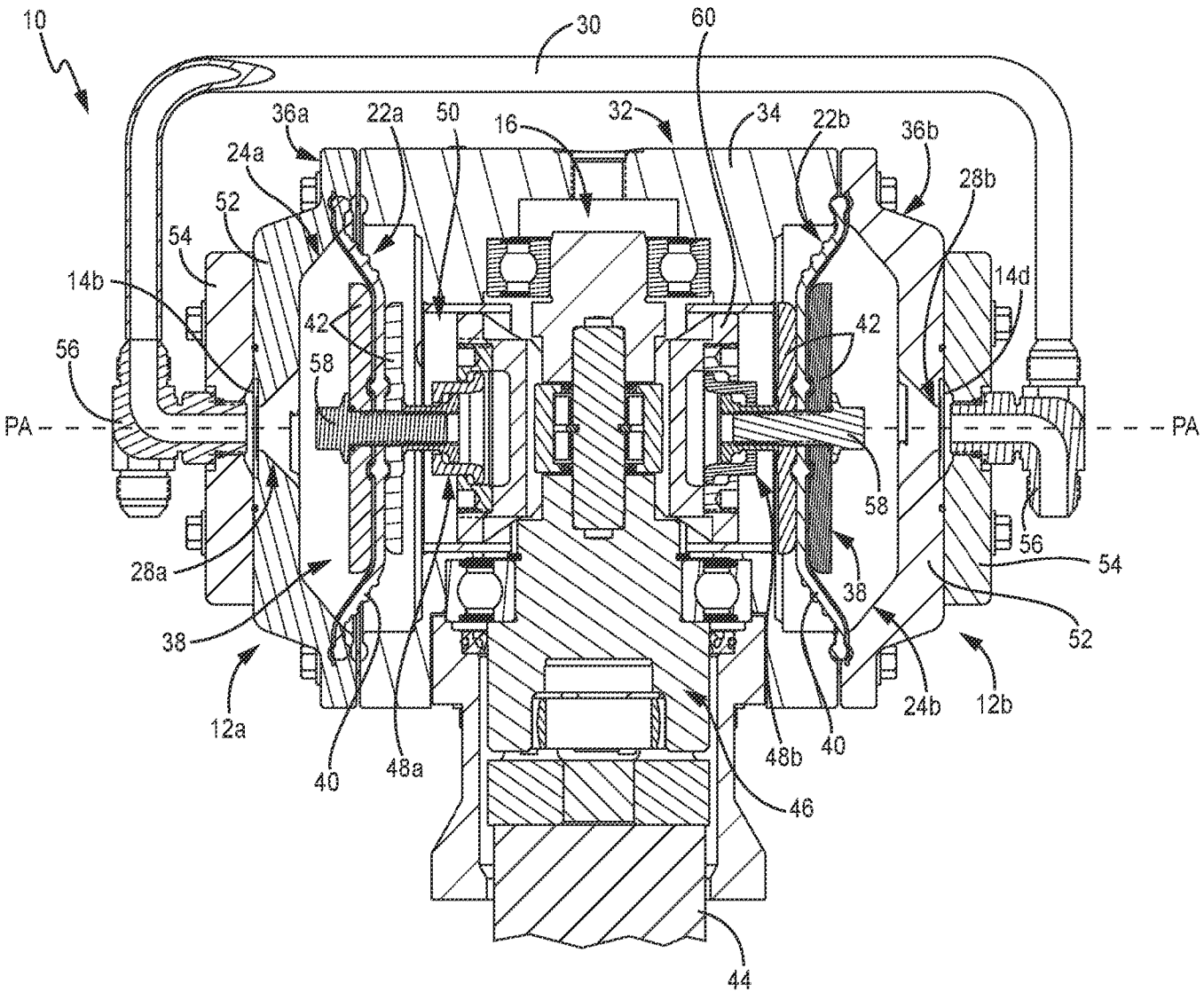
FIG. 2C is a cross-sectional view taken along line C-C in FIG. 2A
Figure 2D:
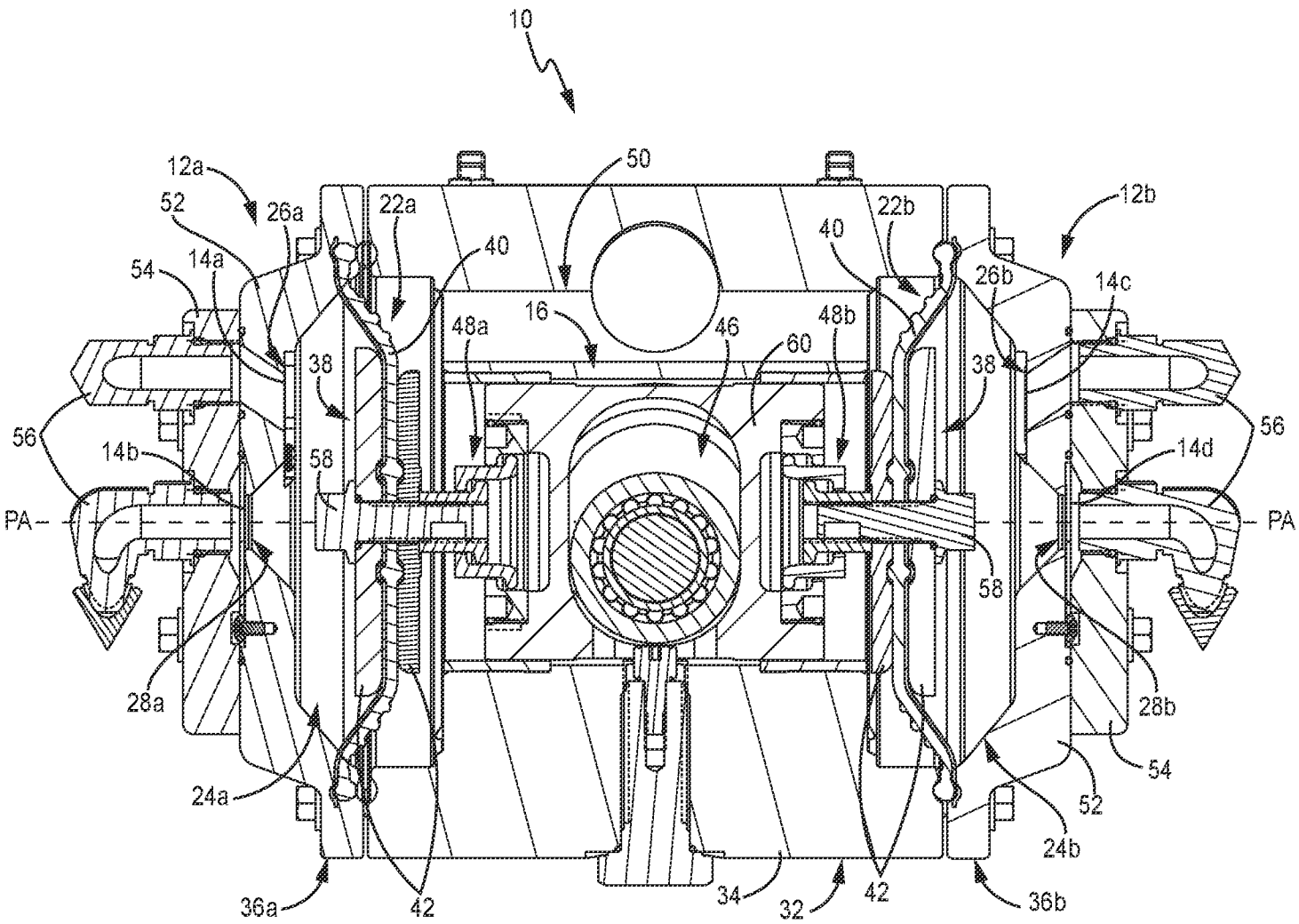
FIG. 2D is a cross-sectional view taken along line D-D in FIG. 2A.

FIG. 2A is an isometric view of pump 10. FIG. 2B is an end view of pump 10. FIG. 2C is a cross-sectional view taken along line C-C in FIG. 2A. FIG. 2D is a cross-sectional view taken along line D-D in FIG. 2A. FIGS. 2A-2D will be discussed together. Compression stages 12*a*, 12*b*; check valves 14*a*, 14*b*; drive 16; fluid displacement members 22*a*, 22*b*; inlets 26*a*, 26*b*; outlets 28*a*, 28*b*; intermediate conduit 30; housing 34, and covers 36*a*, 36*b* of pump 10 are shown. Fluid displacement members 22*a*, 22*b* are shown as diaphragms that include rigid portions 38 and membranes 40. Each rigid portion 38 is formed by plates 42. Motor 44, crank 46, and connectors 48*a*, 48*b* of drive 16 are shown.

Housing 34 supports other components of pump 10. Housing 34 can be a single cast and machined part or can be composed of multiple parts. Housing 34 can be formed from metal, among other material options. Housing 34 can be cylindrical and include a generally hollow interior. Other components of pump 10 can be disposed within the hollow interior of housing 34. In some examples, housing 34 at least partially defines a charge chamber 50. The charge chamber 50 is further defined by fluid displacement members 22*a*, 22*b*. The charge chamber 50 can be filled with a pressurized fluid during operation of pump 10. The pressurized fluid in the charge chamber 50 can, in some examples, be configured to displace each fluid displacement member 22*a*, 22*b* through at least a portion of the respective pump cycle, as discussed in more detail below. As such, a charge pressure within the charge chamber 50 can be used to set the desired output pressure of pump 10.

Pump 10 includes compression stages 12*a*, 12*b* that are configured to serially compress gas. Compression stages 12*a*, 12*b* respectively include compression chambers 24*a*, 24*b* and fluid displacement members 22*a*, 22*b*. Fluid displacement members 22*a*, 22*b* reciprocate on axis PA to compress gas and pump the gas through compression chambers 24*a*, 24*b*. Fluid displacement members 22*a*, 22*b* vary the sizes of compression chambers 24*a*, 24*b*, respectively, as fluid displacement members 22*a*, 22*b* reciprocate such that the available volume in the compression chambers 24*a*, 24*b* increases and decreases as fluid displacement members 22*a*, 22*b* reciprocate. Compression chambers 24*a*, 24*b* are respectively at least partially defined by fluid displacement members 22*a*, 22*b* and by covers 36*a*, 36*b*.

Covers 36*a*, 36*b* are disposed at opposite axial ends of housing 34. Covers 36*a*, 36*b* are fixed to housing 34. Covers 36*a*, 36*b* and housing 34 can together be considered to form a body 32 of pump 10. Covers 36*a*, 36*b* are mounted to housing 34 to form pump body 32. Each cover 36*a*, 36*b* can be formed from a single piece or multiple pieces. Covers 36*a*, 36*b* can be formed from a resilient material capable of interfacing with various gasses. For example, covers 36*a*,

36*b* can be formed from metal, among other options. In the example shown, covers 36*a*, 36*b* have generally circular cross sections taken orthogonal to pump axis PA to fit on the annular ends of the cylindrical housing 34. Covers 36*a*, 36*b* can annularly seal with housing 34. Covers 36*a*, 36*b* at least partially define compression chambers 24*a*, 24*b*, respectively. Cover 36*a* can be identical to cover 36*b*. As such, a single configuration of a cover can be utilized to form both of the upstream compression chamber 24*a* and the downstream compression chamber 24*b*. The common configuration of covers 36*a*, 36*b* reduces part count, simplifies manufacturing, simplifies assembly, and simplifies maintenance. The common configuration of covers 36*a*, 36*b* thus provides time, material, cost, and storage space savings.

Inlets 26*a*, 26*b* provide flowpaths into compression chambers 24*a*, 24*b*, respectively. Outlets 28*a*, 28*b* provide flowpaths out of compression chambers 24*a*, 24*b*, respectively. Inlet 26*a*, which forms the pump inlet in the example shown, is formed in cover 36*a*. Outlet 28*a* is formed in cover 36*a*. Inlet 26*b* is formed in cover 36*b*. Outlet 28*b*, which formed the pump outlet in the example shown, is formed in cover 36*b*. In the example shown, inlets 26*a*, 26*b* and outlets 28*a*, 28*b* define flowpaths having multiple portions. Inlets 26*a*, 26*b* and outlets 28*a*, 28*b* are formed through axially inner portions 52 of covers 36*a*, 36*b* and through axially outer portions 54 of covers 36*a*, 36*b*. Each inlet 26*a*, 26*b* thereby includes a downstream flowpath through the inner portion 52 and an upstream flowpath through the outer portion 54. Each outlet 28*a*, 28*b* includes an upstream flowpath through the inner portion 52 and a downstream flowpath through the outer portion 54. The inner portions 52 of covers 36*a*, 36*b* interface with housing 34. The inner portions 52 can thus be referred to as housing portions. The inner portions 52 of covers 36*a*, 36*b* interface with membranes 40 to form a static seal with membranes 40 to prevent gas from leading out of compression chambers 24*a*, 24*b*. The outer portions 54 of covers 36*a*, 36*b* interface with and are connected to the inner portions 52 of covers 36*a*, 36*b*. Fittings 56 are connected to the outer portions 54 of covers 36*a*, 36*b* at inlets 26*a*, 26*b* and outlets 28*a*, 28*b*. The outer portions 54 of covers 36*a*, 36*b* can thus be referred to as fitting portions.

Inlets 26*a*, 26*b* are radially offset from pump axis PA while outlets 28*a*, 28*b* are disposed on axis PA such that axis PA passes through at least a portion of outlets 28*a*, 28*b*. It is understood, however, that one, some, or all of inlets 26*a*, 26*b* and outlets 28*a*, 28*b* can be disposed at different locations in other embodiments.

One or both of outlets 28*a*, 28*b* can be formed as one or more bores through which pump axis PA extends. In some examples, one or both of outlets 28*a*, 28*b* can be disposed coaxially with pump axis PA. Outlets 28*a*, 28*b* can have one or more portions that define circular cross-sectional areas for the flowpaths defined by outlets 28*a*, 28*b* when taken orthogonal to pump axis PA. Outlets 28*a*, 28*b* being disposed on pump axis PA facilitates efficient pumping and improved pressure and flow control. Outlets 28*a*, 28*b* being aligned on pump axis PA positions outlets 28*a*, 28*b* furthest from fluid displacement members 22*a*, 22*b* along axis PA. Outlets 28*a*, 28*b* facilitate a maximum volume of gas to be evacuated from compression chambers 24*a*, 24*b* by the diaphragms during the respective pumping strokes of fluid displacement members 22*a*, 22*b*.

In the example shown, the bores of outlets 28*a*, 28*b* through inner portions 52 include converging walls such that outlets 28*a*, 28*b* narrow axially outward through the inner portions 52. The bores of outlets 28*a*, 28*b* through inner portions 52 provide a recess that can receive the heads of fasteners 58 during reciprocation of fluid displacement members 22*a*, 22*b*. Outlets 28*a*, 28*b* thereby allows for a longer stoke length, providing in a greater compression ratio in each compression chamber 24*a*, 24*b*.

Intermediate conduit 30 extends between outlet 28*a* and inlet 26*b* to fluidly connect compression chambers 24*a*, 24*b*. Intermediate conduit 30 is connected to fittings 56 at both covers 36*a*, 36*b*. Intermediate conduit 30 transfers compressed gas between covers 36*a*, 36*b*. In the example shown, intermediate conduit 30 is a pipe or tube disposed external to the main housing 34 and that fluidly connects the outlet 28*a* of the first compression stage 12*a* to the inlet 26*b* of the second compression stage 12*b*. The tube forming intermediate conduit 30 is canted relative to pump axis PA. For example, a line CL extending between the first end of the tube at outlet 28*a* and the second end of the tube at inlet 26*b* is transverse relative to pump axis PA. The line CL is still be considered to be transverse to pump axis PA even in cases where the line CL does not directly intersect with pump axis PA.

The entirety of the output of the first compression stage 12*a* is routed into the inlet 26*b* of the second compression stage 12*b* through intermediate conduit 30 such that all of the gas output from the first compression stage 12*a* goes to the second compression stage 12*b*. All of the gas input into the second compression stage 12*b* comes from the first compression stage 12*a*. The second compression stage 12*b* further compresses the gas to higher pressure than was output by the first compression stage 12*a*.

Check valves 14*a*-14*d* are one-way valves that regulate gas flow through pump 10. Check valve 14*a* is associated with inlet 26*a*, check valve 14*b* is associated with outlet 28*a*, check valve 14*c* is associated with inlet 26*b*, and check valve 14*d* is associated with outlet 28*b*. In the example shown, check valves 14*a*-14*d* are formed as flapper valves. The valve members, such as the flappers of the flapper valves, of the check valves 14*a*-14*d* can be metal, such as stainless steel, among other options. In the example shown, the valve members of the outlet check valves 14*b*, 14*d* are disposed between the inner portions 52 and outer portions 54 of covers 36*a*, 36*b*. The bores of outlets 28*a*, 28*b* through outer portions 54 converge axially away from drive 16 to provide space for the valve members of check valves 14*b*, 14*d* to shift between open and closed. In the example shown, the valve members of the inlet check valves 14*a*, 14*c* are disposed on the inner portions 52.

Fluid displacement members 22*a*, 22*b* pump the gas through compression chambers 24*a*, 24*b*. In the example shown, fluid displacement members 22*a*, 22*b* are diaphragms. Diaphragms are at least partially formed from flexible material, such as rubber or other type of polymer. Diaphragms are flexible discs whose center can move relative to its circular peripheral edge. In the example shown, the centers of the diaphragms are formed by rigid portions 38. The outer radial side and the inner radial side, which may be a point on pump axis PA, of each rigid portion 38 remain fixed relative to each other along axis during reciprocation of fluid displacement members 22*a*, 22*b*. In the example shown, plates 42 form the rigid portion 38 of the diaphragms. An axially outer one of plates 42 is exposed to the gas in the respective compression chambers 24*a*, 24*b*. It is understood, however, that rigid portions 38 can be formed in any desired manner, such as by a plate or other component embedded within a flexible member, such as a membrane 40. In such an example, membrane 40 can form the only portion of diaphragm contacting the gas.

A circular peripheral edge of each diaphragm is held in place while the center of the diaphragm is moved through pumping and suction strokes. For example, the circular peripheral edge can be pinched between the housing 34 and respective cover 36*a*, 36*b*. A portion of the diaphragm can thus be secured between one of the covers 36*a*, 36*b* and the housing 34. The center the diaphragm can be moved in a reciprocating manner by drive 16, as further discussed herein. A gas-tight seal is formed between the fluid displacement members 22*a*, 22*b* and pump body 32 to fluidly isolate compression chambers 24*a*, 24*b* from charge chamber 50. In the example show, the peripheral edge of the membrane 40 is clamped between a cover 36*a*, 36*b* and housing 34 to form a static seal. The static seal remains stationary relative to pump axis PA during reciprocation of the fluid displacement member 22*a*, 22*b*.

In the example shown, membranes 40 form the flexible portions of fluid displacement members 22*a*, 22*b*. The flexible portions extend radially between the rigid portion 38 and the static seal between fluid displacement members 22*a*, 22*b* and pump body 32. Membranes 40 are flexible such that the radially outer side of membrane 40 at the static interface and the radially inner side of membrane 40 at rigid portion 38 can move relative to each other along axis PA during reciprocation of the fluid displacement members 22*a*, 22*b*.

Plates 42 are disposed on opposite axial sides of the membrane 40. A portion of membrane 40 is sandwiched between an axially inner one of plates 42 and an axially outer one of plates 42. Plates 42 support the membrane 40. The axially outer plate 42 at least partially defines a respective compression chamber 24*a*, 24*b* and acts on the gas during pumping. A radial gap is formed between the radially outer edge rigid portion 38 the radially inner wall of the cover 36*a*, 36*b* defining compression chamber 24*a*, 24*b*. The radial gap is an annular gap. In the example shown, the radial gap extends annularly around the axially outer one of plates 42. The charge pressure of the pressurized fluid in charge chamber 50 acts on membrane 40 to push membrane 40 axially away from drive 16. The pressurized fluid can cause membrane 40 to project axially though the annular gap between plate 42 and cover 36*a*, 36*b*. Membranes 40 can balloon into the annular gap. Membrane 40 extending into the annular gap reduces the available volume of compression chambers 24*a*, 24*b* when fluid displacement members 22*a*, 22*b* are at the ends of the pressure strokes, thereby increasing the compression ratios of compression stages 12*a*, 12*b*. The increased compression ratio facilitates more efficient pressurization and pumping by pump 10 and facilitates increased output pressures from each compression stage 12*a*, 12*b*.

While the first and second fluid displacement members 22*a*, 22*b* are shown and discussed as diaphragms, the first and second fluid displacement members 22*a*, 22*b* can instead be pistons. Such pistons can be reciprocated back and forth by drive 16 along the axis PA, though pumping and suction strokes. In some examples, fluid displacement members 22*a*, 22*b* are similarly configured. For example, the diaphragms or pistons can have the same diameter for each fluid displacement member 22*a*, 22*b*. It is understood, however, that not all examples are so limited.

Drive 16 is disposed at least partially within housing 34. Drive 16 is operatively connected to fluid displacement members 22*a*, 22*b* to cause reciprocation of fluid displacement members 22*a*, 22*b*. At least a portion of drive 16 can be disposed directly between fluid displacement members 22*a*, 22*b*. Drive 16 includes motor 44. Motor 44 can be an electric rotary type motor, such as an AC induction or DC brushless, among other options. Motor 44 is, in some examples, at least partially disposed within housing 34. In some examples, motor 44 can be fully disposed within housing 34. In some examples, motor 44 can be disposed at least partially directly between fluid displacement members 22*a*, 22*b*. In the example shown, motor 44 projects vertically below housing 34 to minimize a footprint of pump 10. Motor 44 is operatively connected to crank 46 to operate crank 46.

Crank 46 includes an eccentric or cam that moves connectors 48*a*, 48*b*. In the example shown, crank 46 is disposed directly between fluid displacement members 22*a*, 22*b*. Connectors 48*a*, 48*b* are attached to crank 46 to be reciprocated along pump axis PA. The asymmetry of the rotating portion of the crank 46 can cause first connector 48*a* to move the first fluid displacement member 22*a* through a suction stroke while the second connector 48*b* moves the second fluid displacement member 22*b* through a pumping stroke. The movement can then be reversed as the crank 46 moves to another phase of its rotation to cause the first connector 48*a* to move the first fluid displacement member 22*a* through the pumping stroke while the second connector 48*b* moves the second fluid displacement member 22*b* through a suction stroke. In the example shown, connectors 48*a*, 48*b* are attached to fluid displacement members 22*a*, 22*b* by fasteners 58. In the example shown, crank 46 interfaces with shuttle 60 to cause reciprocation of shuttle 60 along pump axis PA. Connectors 48*a*, 48*b* interface with shuttle 60 to cause reciprocation of connectors 48*a*, 48*b*.

In the example shown, connectors 48*a*, 48*b* only pull fluid displacement members 22*a*, 22*b* through suction strokes. Connectors 48*a*, 48*b* do not force fluid displacement members 22*a*, 22*b* through pumping strokes. Connectors 48*a*, 48*b* can also be referred to as pulls. Connectors 48*a*, 48*b* are movable relative to shuttle 60 and within the connector receiving chambers formed in shuttle 60. Connectors 48*a*, 48*b* can decouple fluid displacement members 22*a*, 22*b* from crank 46 to facilitate relative axial movement therebetween. In the example show, connectors 48*a*, 48*b* are configured to decouple fluid displacement members 22*a*, 22*b* during respective pumping strokes.

In the example shown, the pressurized fluid within charge chamber 50 acts on the inner axial sides of fluid displacement members 22*a*, 22*b* (e.g., both on the axially inner plate 42 and inner face of membrane 40) to exert a driving force on fluid displacement members 22*a*, 22*b*. The driving force pushes fluid displacement members 22*a*, 22*b* to drive fluid displacement members 22*a*, 22*b* axially outward through respective pumping strokes. An advantage of such a system is that the pumping pressure is generally managed by the charge pressure inside the housing and the output pressure of the gas (e.g., the second pressure) is not susceptible to the pressures spikes of (sometimes inflexible) mechanical system.

In a deadhead condition, fluid displacement members 22*a*, 22*b* can stop moving but shuttle 60 can continue to reciprocate relative to connectors 48*a*, 48*b* and fluid displacement members 22*a*, 22*b*, reducing the load and wear on drive 16 that can be caused by starts and stops. In some examples, the downstream fluid displacement member 22*b* can be in a deadhead condition due to standing pressure built in second compression chamber 24*b* while the upstream fluid displacement member 22*a* continues to reciprocate to build pressure in intermediate conduit 30 and, in some examples, compression chamber 24*a*. As such, the upstream one of fluid displacement members 22*a* can complete one or more pump strokes, suction strokes, and/or pump cycles while the downstream fluid displacement member 22*b* remains stationary.

In some examples, the reciprocation of the fluid displacement members 22*a*, 22*b* is entirely managed by pressurized fluid within the main housing 34 such that the fluid displacement members 22*a*, 22*b* are not mechanically driven through either pumping or suction stroke. For example, working fluid can be flowed to and vented from various chambers within housing 34 to cause reciprocation of fluid displacement members 22*a*, 22*b*.

In some examples, connectors 48*a*, 48*b* are axially fixed relative to both fluid displacement members 22*a*, 22*b*. Fluid displacement members 22*a*, 22*b* are thereby coupled for simultaneous movement along axis PA. For example, fluid displacement members 22*a*, 22*b* can be coupled to be 180-degrees out of phase relative to each other, such that one fluid displacement member 22*a*, 22*b* is at the end of a suction stroke while the other fluid displacement member 22*a*, 22*b* is at the end of a pumping stroke. The pumping cycles of the fluid displacement members 22*a*, 22*b* can be out of phase such that the first diaphragm and the second diaphragm are not concurrently in either one of the pumping stroke and the suction stroke. The pumping cycles of fluid displacement member 22*a* can be out of phase with respect to the pumping cycles of the fluid displacement member 22*b* such that one of the fluid displacement members 22*a*, 22*b* is performing a pumping stroke while the other fluid displacement member 22*a*, 22*b* is performing a suction stroke.

Drive 16 causes reciprocation of fluid displacement members 22*a*, 22*b* to cause pumping by pump 10. Drive pulls fluid displacement member 22*a* in first axial direction AD1 and through a suction stroke to increase the volume of compression chamber 24*a*. Fluid displacement member 22*a* draws gas into compression chamber 24*a* through check valve 14*a*. Simultaneously, the pressurized fluid in charge chamber 50 pushes fluid displacement member 22*b* through a pumping stroke to decrease the volume of compression chamber 24*b*. If compression chamber 24*b* is charged to a standing pressure sufficient to open check valve 14*d*, then second compression stage 12*b* discharges pressurized gas downstream. If the standing pressure in compression chamber 24*b* does not reach a level sufficient to overcome the resistance at check valve 14*d*, then fluid displacement member 22*b* compresses the gas to increase the pressure in compression chamber 24*b*.

Drive 16 then causes fluid displacement member 22*a* to changeover to a pumping stroke, which closes the first compression stage inlet check valve 14*a* as the movement of the first fluid displacement member 22*a* decreases the volume of compression chamber 24*a* and further increases the gas pressure of the pressurized gas within first compression chamber 24*a*. The pressurized fluid in charge chamber 50 can drive fluid displacement member 22*a* through the pumping stroke. Drive 16 also causes the first fluid displacement member 22*b* to changeover to the suction stroke as the second compression stage outlet check valve 14*d* closes and the second compression stage inlet check valve 14*c* opens to allow the entry of more gas into the second compression chamber 24. The pump cycles of fluid displacement members 22*a*, 22*b* repeat as long as pump 10 is operated to pump and compress gas. In some examples, fluid displacement member 22*a* moving through the pumping stroke both outputs gas from outlet 28*a* and drives gas into compression chamber 24*b* through inlet 26*b*. In some examples, at least a portion of the gas driven into compression chamber 24*b* is different from the gas output by fluid displacement member 22*a* during that pumping stroke (e.g., the gas had been output by a previous pumping stroke).

In some examples, first compression stage 12*a* and second compression stage 12*b* are similarly configured to serially compress the gas. For example, each compression stage 12*a*, 12*b* can have the same or similar compression ratios. The compression ratios control the pressure that can be generated. Compression stage 12*b* receives the gas at an elevated pressure (e.g., that output by first compression stage 12*a*) relative to the gas received by compression stage 12*a* and can further pressurize the gas to output the gas at a second pressure level higher than the first pressure level output by compression stage 12*a*. The similar compression ratios provide uniform loading on components of pump 10 and drive 16, reducing wear and maintenance costs. The similar compression ratios facilitate increased output pressure with a smaller footprint of pump 10. It is understood, however, that not all examples are so limited.

In some examples, compression stage 12*a* is configured to displace a larger volume of gas per pump stroke than compression stage 12*b*. For example, fluid displacement members 22*a*, 22*b* can be of differing configurations (e.g., different diameters). Fluid displacement member 22*a* can have a greater gas-contacting cross-sectional area (e.g., represented by an area exposed to a respective compression chamber 24*a*, 24*b*) than fluid displacement member 22*b*. Compression stage 12*a* can thereby displace a greater volume of gas per pump stroke than compression stage 12*b* despite the same travel distance for each pumping stroke. In additional or alternative examples, compression chamber 24*a* can have a larger maximum volume than compression chamber 24*b*. For example, fluid displacement members 22*a*, 22*b* can have similar sizes but different displacement lengths.

As shown, a single drive mechanism (e.g., drive 16) operates two compressors in series. For example, a single motor 44 operates two compressors (e.g., displaces first and second fluid displacement members 22*a*, 22*b*) in series. These compressors are supported by a common housing 34. In another aspect, a single crank (or other type of eccentric) operates first and second fluid displacement members 22*a*, 22*b* to compress gas in series. In various embodiments, at least part of the drive 16 is located directly between the first and second fluid displacement members 22*a*, 22*b*. In some embodiments, the entire drive 16 is located directly between the first and second fluid displacement members 22*a*, 22*b*. As another aspect, a single crank (or other type of eccentric) is located at least partially between first and second fluid displacement members 22*a*, 22*b* to compress gas in series. In some embodiments, the single crank (or other type of eccentric) is located entirely directly between first and second fluid displacement members 22*a*, 22*b* to compress gas in series.

It is understood that the flow rate of the pump 10 when pumping in the serial compression mode is decreased as compared to conventional double diaphragm pumps because all of the compressed gas flows serially through each compression chamber 24*a*, 24*b* in stages instead of being used to pump in parallel. While flow rate is decreased relative to a conventional double diaphragm pump with parallel pumping chambers, output pressure is increased. In addition, pump 10 outputs gas at flowrates greater than those capable of being produced by comparably sized piston pumps, which are typically single displacement.

Pump 10 provides significant advantages. Compression stages 12*a*, 12*b* can be commonly configured and serially compress the gas. The common configurations of fluid displacement members 22*a*, 22*b* and/or covers 36*a*, 36*b* reduces part count and facilitates efficient maintenance and assembly. Pump 10 thereby reduces downtime and increases productivity. Pump 10 can pump at higher pressures as compared to standard double diaphragm pumps. Pump 10 can also pump at higher flow rates as compared to piston gas compressors. Fluid displacement members 22*a*, 22*b* are disposed coaxially on pump axis PA, balancing the load on drive 16 and fluid displacement members 22*a*, 22*b*. The pressurized fluid in charge chamber 50 causes membrane 40 to extend axially outward, away from charge chamber 50 and into a respective compression chamber 24*a*, 24*b* in the annular gap between plate 42 and the inner wall of a respective cover 36*a*, 36*b*. The bulging of membrane 40 reduces the minimum volume of compression chambers 24*a*, 24*b* with fluid displacement members 22*a*, 22*b* at the end of a pumping stroke, providing an improved compression ratio and evacuation from compression chamber 24*a*, 24*b*. Diaphragms form static seals that have reduced wear as compared to moving, dynamic seals. Pump 10 thereby reduces downtime and maintenance costs.

Figure 3A:
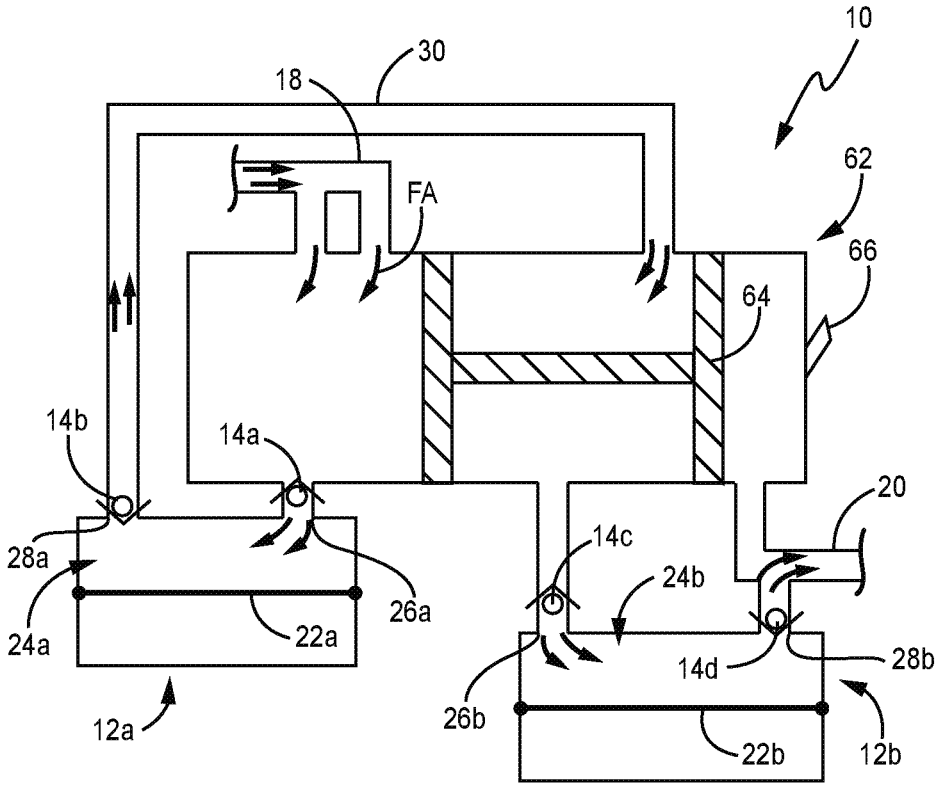
FIG. 3A is a schematic block diagram of a pump in a serial flow mode.
Figure 3B:
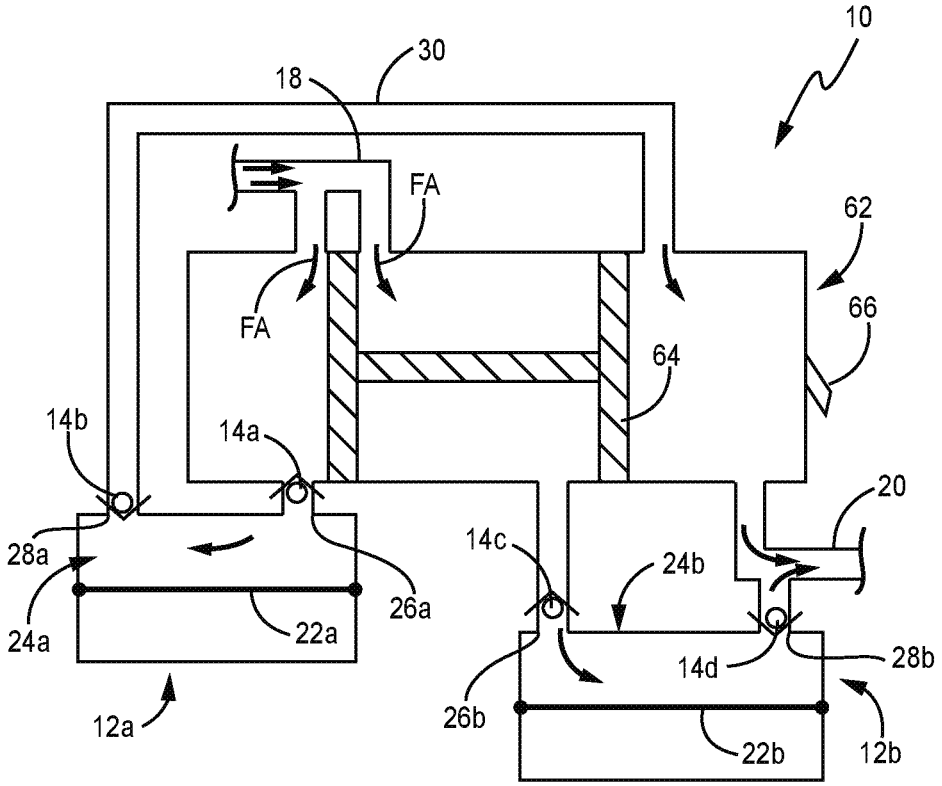
FIG. 3B is a schematic block diagram of a pump in a parallel flow mode.

FIG. 3A is a schematic diagram of pump 10 in a serial pumping mode. FIG. 3B is a schematic diagram of pump 10 in a parallel pumping mode. FIGS. 3A and 3B will be discussed together. Pump 10 includes compression stages 12*a*, 12*b*, check valves 14*a*-14*d*, inlet conduit 18, outlet conduit 20, and switching valve 62. Compression stages 12*a*, 12*b* respectively includes fluid displacement members 22*a*, 22*b* and compression chambers 24*a*, 24*b*. Switching valve 62 includes flow director 64 and actuator 66.

Pump 10 is configured to pump in a serial flow mode and a parallel flow mode. In the serial flow mode, the process gas flows serially from the inlet conduit 18 to compression stage 12*a*, from compression stage 12*a* to compression stage 12*b*, and from compression stage 12*b* to outlet conduit 20. No process gas flows through compression stage 12*b* without first passing through and being pressurized by compression stage 12*a* with pump 10 in the serial flow mode. In the parallel flow mode, compression stages 12*a*, 12*b* are fluidly isolated from each other. The process gas flows from inlet conduit 18 to one of compression stages 12*a*, 12*b* and from the compression stages 12*a*, 12*b* directly to outlet conduit 20. No process gas passes from one compression stage 12*a*, 12*b* to the other compression stage 12*a*, 12*b* in the parallel flow mode.

Pump 10 is shown as including switching valve 62 to actuate pump 10 between the serial and parallel flow modes. Switching valve 62 is configured to direct flows of the process fluid based on whether switching valve 62 is in a first state associated with the serial flow mode (shown in FIG. 3A) or if switching valve 62 is in a second state associated with the parallel flow mode (shown in FIG. 3B). Flow director 64 is disposed within a body of switching valve 62 and is movable between a first position (shown in FIG. 3A) associated with the serial flow mode and a second position (shown in FIG. 3B) associated with the parallel flow mode. Actuator 66 is operatively connected to flow director 64 to move the flow director 64 between the first and second positions. For example, actuator 66 can be a toggle, knob, switch, button, slider, or of any other form suitable for causing a change in the position of flow director 64. Actuator 66 can be mechanically, electrically, magnetically and/or otherwise connected to flow director 64 to shift flow director 64.

With pump 10 in the serial flow mode, flow director 64 is in the first position and inlet conduit 18 is directly fluidly connected to inlet 26*a* of compression stage 12*a* and fluidly isolated from inlet 26*b* of compression stage 12*b*. The full volume of gas entering pump 10 from inlet conduit 18 flows to compression chamber 24*a* through inlet 26*a* and check valve 14*a*. Fluid displacement member 22*a* is driven through a pumping stroke to pressurize the gas and drive the gas downstream out of compression chamber 24*a* through outlet 28*a* and check valve 14*b*. Compression stage 12*a* outputs the gas at a first pressure.

The output from compression stage 12*a* flows to switching valve 62. Switching valve 62 fluidly isolates the output from compression stage 12*a* from both inlet conduit 18 and outlet conduit 20. Switching valve 62 directly fluidly connects the output from compression stage 12*a* to compression stage 12*b*. The gas flows to compression chamber 24*b* through inlet 26*b* and check valve 14*c*. The gas received by compression stage 12*b* is at the first pressure, which is elevated as compared to the gas pressure input to compression stage 12*a*. Fluid displacement member 22*b* is driven through a pumping stroke to drive the gas downstream out of compression chamber 24*b* through outlet 28*b* and check valve 14*d*. The gas is output to outlet conduit 20 by compression stage 12*b*. Compression stage 12*b* outputs the gas at a second pressure that can be elevated relative to the first pressure.

Pump 10 can be placed in the parallel flow mode to provide a greater flow rate of the gas as compared to the serial flow mode. Actuator 66 is actuated to cause flow director 64 to move from the first position shown in FIG. 3A to the second position shown in FIG. 3B. With flow director 64 in the second position, inlet conduit 18 is fluidly connected to both inlet 26*a* and inlet 26*b*, outlet 28*a* is fluidly isolated from inlet 26*b*, and outlet 28*a* is fluidly connected to outlet conduit 20. The gas flow from inlet conduit 18 flows to both inlet 26*a* of compression stage 12*a* and inlet 26*b* of compression stage 12*b*. The gas flows to compression chamber 24*a* though inlet 26*a* and check valve 14*a* and to compression chamber 24*b* through inlet 26*b* and check valve 14*c*.

Fluid displacement member 22*a* is driven through a pumping stroke to drive the gas downstream out of compression chamber 24*a* through outlet 28*a* and check valve 14*b*. Flow director 64 fluidly isolates the output from compression stage 12*a* from the inlet 26*b* of compression stage 12*b* and fluidly connects the output from compression stage 12*a* with outlet conduit 20. As such, compression stage 12*a* directly provides pressurized gas to outlet conduit 20 with pump 10 in the parallel flow mode.

Simultaneously to or out of phase with fluid displacement member 22*a*, fluid displacement member 22*b* is driven through a pumping stroke to drive the gas downstream out of compression chamber 24*b* through outlet 28*b* and check valve 14*d*. The output from compression stage 12*b* is provided to outlet conduit 20 with pump 10 in both the serial flow mode and the parallel flow mode.

Pump 10 provides significant advantages. Pump 10 can be actuated between the serial flow mode, providing higher pressure relative to the parallel flow mode, and the parallel flow mode, providing higher flow relative to the serial flow mode. Pump 10 thereby facilitates both high flow and high pressure applications, reducing costs and increasing operational efficiency. Switching valve 62 provides a simple, efficient manner of actuating pump 10 between the serial flow and parallel flow modes.

Figure 4:
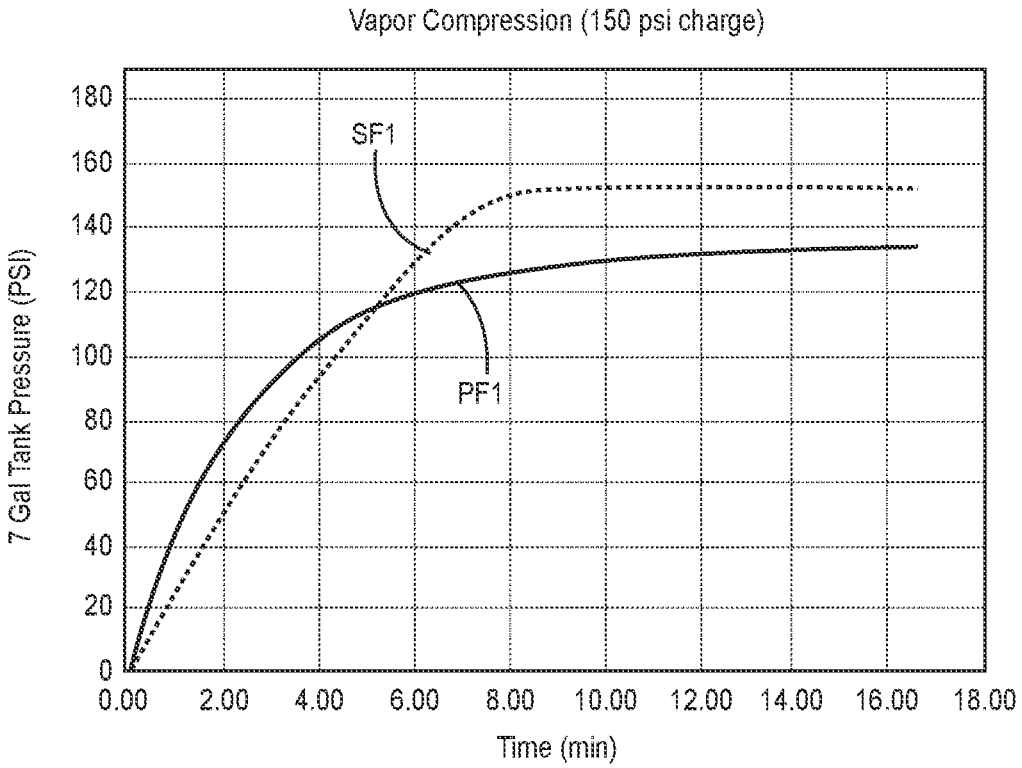
FIG. 4 is a graph showing standing pressure over time for a pump in a parallel flow mode and in a serial flow mode.

FIG. 4 is a graph showing a standing pressure built downstream of pump 10 over time for pump 10 operating in the parallel flow mode and the serial flow mode. The graph of FIG. 4 shows pump 10 operating with a charge pressure of about 1.03 MPa (about 150 psi) in charge chamber 50. The lower horizontal axis represents time and the left vertical axis represents pressure downstream of pump 10 (e.g., downstream of outlet 28*b*). In the example shown, parallel flow line PF1 represents the output from pump 10 operating in the parallel flow mode, while serial flow line SF1 represents the output from pump 10 operating in the serial flow mode. The example shows pressure build in a downstream tank having a capacity of 7-gallons. It is understood that similar pressure vs. time profiles for line PF and line SF are applicable for downstream locations having different capacities, with reduced time to reach pressure in larger volume tanks and increased time to build pressure in larger volume tanks.

As shown, pump 10 can initially build pressure more quickly when operating in the parallel flow mode. However, the pressure output by pump 10 operating in the serial flow mode overtakes and exceeds the pressure output during the parallel flow mode prior to the parallel flow mode reaching a maximum pressure output. Pump 10 continues to build pressure generally linearly during the serial flow mode as the pressure output during the parallel flow mode levels off.

The compression ratios of compression stages 12*a*, 12*b* limit the maximum pressure that can be output by any one of compression stages 12*a*, 12*b*. Pre-pressurizing the gas in compression stage 12*a* facilitates a further increase in pressure even with the same or similar compression ratio. The serial flow line SF1 shows that pump 10 can output pressure up to about the charge pressure in charge chamber 50, whereas the parallel flow line PF1 shows that the maximum pressure output by pump 10 in the parallel flow mode is a fraction of the charge pressure. The serial flow mode of pump 10 thereby provides greater pressure control as the actual maximum output pressure corresponds to the charge pressure. The user can thus set the charge pressure in charge chamber 50 to control the output pressure as the maximum pressure output by pump 10 during the serial flow mode directly corresponds with the charge pressure.

Figure 5:
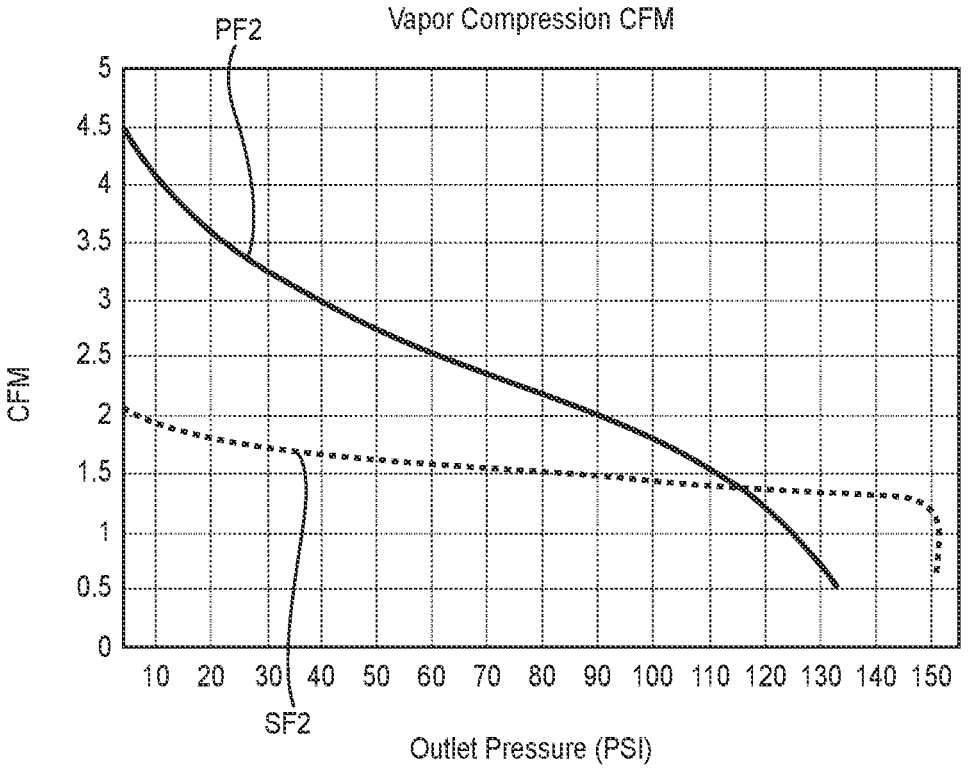
FIG. 5 is a graph showing flow rate for an output pressure for a pump in a parallel flow mode and in a serial flow mode.

FIG. 5 is a graph showing gas pressure verses flow rate output from pump 10 operating in the parallel flow mode and the serial flow mode. The graph of FIG. 5 shows pump 10 operating with a charge pressure of about 1.03 MPa (about 150 psi) in charge chamber 50. The lower horizontal axis pressure downstream of pump 10 (e.g., downstream of outlet 28*b*) and the vertical axis represents flow rate in cubic feet per minute (CFM). In the example shown, parallel flow line PF2 represents the output from pump 10 operating in the parallel flow mode, while serial flow line SF2 represents the output from pump 10 operating in the serial flow mode.

As shown, pump 10 can output a greater flow rate while operating in the parallel flow mode as compared to the serial flow mode at relatively lower pressures. However, pump 10 can begin to produce a higher flow rate in the serial flow mode as compared to the parallel flow mode prior to the pressure output during the parallel flow mode reaching a maximum pressure. In some examples, pump 10 can have a variation from a maximum flow at minimum pressure and a maximum flow at maximum pressure of less than about 50%. In some examples, the variation is less than about 35%. As shown by serial flow line SF2, pump 10 in the example shown has a variation in flow rate of less than about 40% between the maximum flow rate (about 2 CFM in the example shown) at the minimum pressure output (about 34.5 kilopascal (KPa) (about 5 psi) in the example shown) and the maximum flow rate (about 1.25 CFM in the example shown) at the maximum pressure output (about 1.03 MPa (about 150 psi) in the example shown). In some examples, pump 10 can have a variation in flow rate in a middle third of the pressure range of less than about 10% from the flow rate at the low end of the middle third of the pressure range (at about 0.35 MPa (about 50 psi) in the example shown) to flow rate at the high end of the middle third of the pressure range (at about 0.69 MPa (about 100 psi) in the example shown). In some examples, pump 10 can have a variation in flow rate in a middle two-thirds of the pressure range of less than about 25% from the flow rate at the low end of the middle two-thirds of the pressure range (at about 0.17 MPa (about 25 psi) in the example shown) to flow rate at the high end of the middle two-thirds of the pressure range (at about 0.86 MPa (about 125 psi) in the example shown). In some examples, pump 10 can have a variation in flow in a middle 50% of the pressure range of less than about 20% from the flow rate at the low end of the middle 50% of the pressure range (at about 0.26 MPa (about 37.5 psi) in the example shown) to flow rate at the high end of the middle 50% of the pressure range (at about 0.78 MPa (about 112.5 psi) in the example shown). In some examples, pump 10 can have a variation in flow rate in an upper half of the pressure range of less than about 20% from the flow rate at the low end of the upper half of the pressure range (at about 0.52 MPa (about 75 psi) in the example shown) to flow rate at the high end of the upper half of the pressure range (at about 1.03 MPa (about 150 psi) in the example shown). In some examples, pump 10 can have a variation in flow rate of in an upper half of the pressure range of less than about 20% from the flow rate at the low end of the upper half of the pressure range (at about 0.52 MPa (about 75 psi) in the example shown) to flow rate at the high end of the upper half of the pressure range (at about 1.03 MPa (about 150 psi) in the example shown). Pump 10 provides a relatively consistent flow rate across a variety of output pressures. The steady flow across a wide pressure range provides consistency between applications and facilitates efficient gas recovery.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump configured to serially compress a gas, the pump comprising:

a housing;

a first compression stage having a first diaphragm, a first stage inlet, and a first stage outlet, the first diaphragm configured to reciprocate on a pump axis to alter a volume of a first compression chamber of the first compression stage;

a second compression stage having a second diaphragm a second stage inlet and a second stage outlet, the second diaphragm configured to reciprocate on the pump axis to alter a volume of a second compression chamber of the second compression stage;

a first cover at least partially defining the first compression chamber and mounted to a first end of the housing, wherein the first cover comprises:

a first inner plate mounted to the housing; and a first outer plate mounted to the first inner plate such that the first inner plate is disposed between the first outer plate and the first diaphragm;

wherein first stage inlet is formed through the first inner plate and the first outer plate, and wherein the first stage outlet is formed through the first inner plate and the first outer plate;

a second cover at least partially defining the second compression chamber and mounted to a second end of the housing, wherein the second cover comprises:

a second inner plate mounted to the housing; and a second outer plate mounted to the second inner plate such that the second inner plate is disposed between the second outer plate and the second diaphragm;

wherein second stage inlet is formed through the second inner plate and the second outer plate, and wherein the second stage outlet is formed through the second inner plate and the second outer plate;

a first check valve configured to allow flow into the first compression chamber and prevent retrograde flow out of the first compression chamber;

a second check valve captured between the first inner plate and the first outer plate, the second check valve configured to allow flow out of the first compression chamber and prevent retrograde flow into the first compression chamber, wherein the second check valve is configured to open based on a pressure within the first compression chamber reaching a first pressure threshold;

a third check valve captured between the second inner plate and the second outer plate, the third check valve configured to allow flow out of the second compression chamber and prevent retrograde flow into the second compression chamber, wherein the third check valve is configured to open based on a pressure in the second compression chamber exceeding a crack pressure greater than the first pressure threshold such that the crack pressure is configured to be built in the second compression chamber over a plurality of pumping cycles of the first diaphragm;

a first inlet fitting mounted to the first outer plate and fluidly connected to the first stage inlet;

a first outlet fitting mounted to the first outer plate and fluidly connected to the first stage outlet;

a second inlet fitting mounted to the second outer plate and fluidly connected to the second stage inlet;

a second outlet fitting mounted to the second outer plate and fluidly connected to the second stage outlet; and a drive disposed at least partially between the first diaphragm and the second diaphragm, the drive operably connected to the first diaphragm and the second diaphragm to displace the first diaphragm through a first suction stroke and to displace the second diaphragm through a second suction stroke; and wherein the first compression stage is fluidly connected to the second compression stage such that gas compressed in the first compression chamber in the first compression stage is routed to the second compression chamber.

2. The pump of claim 1, further comprising: a fourth check valve that permits gas output from the first compression chamber to enter the second stage inlet and prevents compressed gas within the second compression chamber from escaping through the second stage inlet.

3. The pump of claim 2, wherein the pump is configured to build standing pressure between the second check valve and the fourth check valve based on standing pressure being built downstream in the second compression chamber.

4. The pump of claim 1, wherein a first compression ratio of the first compression stage is the same as a second compression ratio of the second compression stage.

5. The pump of claim 4, wherein the first diaphragm has a first diameter and the second diaphragm has a second diameter, and wherein the first diameter is the same as the second diameter.

6. The pump of claim 1, wherein each of the first compression chamber, the second compression chamber, the first diaphragm, and the second diaphragm are at least partially disposed within the housing during at least a portion of a pump cycle.

7. The pump of claim 1, wherein:

a charge chamber is disposed within the housing between the first diaphragm and the second diaphragm, wherein the charge chamber is configured to be filled with a pressurized fluid configured to displace the first diaphragm and the second diaphragm through respective pumping strokes; and the first diaphragm comprises:

a first rigid portion forming an inner diameter portion of the first diaphragm; and a first membrane extending radially outward from the first rigid portion and secured between the first cover and the first end of the housing at a first static interface, the first membrane having an outer side and an inner side, the outer side at least partially defining the first compression chamber;

wherein a portion of the first membrane radially between the rigid portion and the static interface is configured to flex axially into the first compression chamber.

8. The pump of claim 7, wherein the rigid portion includes a first plate disposed on the outer side of the first membrane and a fastener extending through the first plate and the membrane to connect the first diaphragm to the drive.

9. The pump of claim 7, wherein:

a pumping cycle of the plurality of pumping cycles of the first diaphragm comprises a first pumping stroke and the first suction stroke;

a pumping cycle of a plurality of pumping cycles of the second diaphragm comprises a second pumping stroke and the second suction stroke; and the plurality of pumping cycles of the first diaphragm are out of phase with respect to the plurality of pumping cycles of the second diaphragm such that the first diaphragm is performing a pumping stroke while the second diaphragm is performing a suction stroke.

10. The pump of claim 9, wherein the plurality of pumping cycles of the first diaphragm and the plurality of pumping cycles of the second diaphragm are offset by 180-degrees such that the first diaphragm and the second diaphragm are not concurrently in either one of the pumping stroke and the suction stroke.

11. The pump of claim 1, wherein:

the first stage outlet and the second stage outlet are disposed on the pump axis.

12. The pump of claim 11, wherein the first cover and the second cover are configured such that the first cover is mountable to the second end to form the second cover and the second cover is mountable to the first end to form the first cover.

13. The pump of claim 1, further comprising:

a tube extending between the first stage outlet and the second stage inlet, wherein the tube is canted relative to the pump axis.

14. The pump of claim 1, wherein the drive includes an electric motor that moves the first diaphragm and the second diaphragm.

15. The pump of claim 14, wherein the drive includes a crank, at least a portion of the crank disposed directly between the first diaphragm and the second diaphragm.

16. The pump of claim 1, further comprising:

a switching valve connected to the first compression stage and the second compression stage, the switching valve actuatable to put the pump in a serial flow mode and a parallel flow mode, wherein:

in the serial flow mode, the switching valve fluidly connects an intake flow of gas with the first stage inlet and fluidly connects an outlet flow from the first stage outlet of the first compression stage with the second stage inlet;

in the parallel flow mode, the switching valve fluidly connects the intake flow of gas with the first stage inlet and the second stage inlet and fluidly connects the second stage outlet with a pump outlet; and the second stage outlet is fluidly connected to the pump outlet during both the serial flow mode and the parallel flow mode.

17. A method of compressing a gas, the method comprising:

reciprocating a first diaphragm along a pump axis and a second diaphragm along the pump axis with a drive, at least a portion of the drive disposed directly between the first diaphragm and the second diaphragm;

compressing the gas in a first compression chamber to a first pressure with the first diaphragm;

expelling the compressed gas from the first compression chamber through a first outlet of the first compression chamber;

routing the compressed gas from the first compression chamber into a second compression chamber;

amassing the compressed gas in the second compression chamber over a plurality of cycles of the first diaphragm and compressing the compressed gas to a second pressure greater than the first pressure in the second compression chamber with a second diaphragm configured to reciprocate on the pump axis; and expelling the compressed gas from the second compression chamber based on the second pressure exceeding a crack pressure of an outlet check valve of the second compression chamber;

wherein a pumping stroke of the first diaphragm both compresses the gas within the first compression chamber and moves previously compressed gas into the second compression chamber.

18. A pump configured to serially compress a gas, the pump comprising:

a first compression stage having a first fluid displacement member, a first stage inlet, and a first stage outlet, the first fluid displacement member configured to reciprocate on a pump axis to alter a volume of a first compression chamber of the first compression stage;

a second compression stage having a second fluid displacement member a second stage inlet and a second stage outlet, the second fluid displacement member configured to reciprocate on the pump axis to alter a volume of a second compression chamber of the second compression stage;

a drive disposed at least partially between the first fluid displacement member and the second fluid displacement member, the drive operably connected to the first fluid displacement member and the second fluid displacement member to displace the first fluid displacement member through a first suction stroke and to displace the second fluid displacement member through a second suction stroke; and wherein the first compression stage is fluidly connected to the second compression stage such that gas compressed in the first compression chamber in the first compression stage is routed to the second compression chamber;

wherein the first stage outlet and the second stage outlet are disposed on the pump axis; and wherein each of the first fluid displacement member and the second fluid displacement member have a circular cross-sectional orthogonal to and coaxial with the pump axis.

* * * * *